US007458303B2

(12) United States Patent
Walker

(10) Patent No.: US 7,458,303 B2
(45) Date of Patent: Dec. 2, 2008

(54) PERFORATING GUN LOADING BAY AND METHOD

(75) Inventor: Troy S. Walker, Red Deer (CA)

(73) Assignee: Walker's Holdings Inc., Red Deer (CA)

( * ) Notice: Subject to any disclaimer, the term of this patent is extended or adjusted under 35 U.S.C. 154(b) by 0 days.

(21) Appl. No.: 11/689,873

(22) Filed: Mar. 22, 2007

(65) Prior Publication Data

US 2007/0289472 A1 Dec. 20, 2007

Related U.S. Application Data

(62) Division of application No. 10/358,382, filed on Feb. 5, 2003, now Pat. No. 7,308,847.

(60) Provisional application No. 60/353,957, filed on Feb. 5, 2002.

(51) Int. Cl.
*F42B 4/30* (2006.01)

(52) U.S. Cl. ..... 86/50; 86/20.1

(58) Field of Classification Search ..... 86/50, 86/20.1

See application file for complete search history.

(56) References Cited

U.S. PATENT DOCUMENTS 3,093,098 A 6/1963 Rosenfeld
3,301,041 A 1/1967 Mueller
3,385,073 A 5/1968 Snelling
3,946,950 A 3/1976 Graff
4,100,783 A * 7/1978 Gambarov et al. ..... 72/56
4,276,725 A 7/1981 Ash
4,325,309 A * 4/1982 King et al. ..... 109/49.5
4,632,041 A 12/1986 Ohlson
5,135,130 A 8/1992 Andrews
5,248,055 A 9/1993 Sanai et al.
5,274,356 A * 12/1993 Taricco ..... 340/515
5,495,812 A * 3/1996 Schulze ..... 110/237
5,875,996 A 3/1999 Borgia
5,884,709 A 3/1999 Evans et al.
6,138,420 A 10/2000 Fyfe
6,173,662 B1 1/2001 Donovan
6,196,107 B1 3/2001 Hoffman et al.
6,354,181 B1 3/2002 Donovan

OTHER PUBLICATIONS

Photo of a Perforating Gun Loading Bay, pre. Feb. 5, 2002.

* cited by examiner

*Primary Examiner*—Stephen M Johnson
(74) *Attorney, Agent, or Firm*—Bennett Jones LLP

(57) ABSTRACT

A perforating gun loading bay is described for protecting adjacent areas from an accidental explosion during gun loading. The bay can be an insert-type arrangement or a stand-alone structure. The bay includes metal plate walls, a floor and a roof.

9 Claims, 8 Drawing Sheets

PERFORATING GUN LOADING BAY AND METHOD

CROSS REFERENCE TO RELATED APPLICATIONS

This is a divisional application of U.S. application Ser. No. 10/358,382 filed Feb. 5, 2003 now U.S. Pat. No. 7,308,847, presently pending. U.S. application Ser. No. 10/358,382 and the present application claim priority from U.S. provisional patent application Ser. No. 60/353,957 filed Feb. 5, 2002.

FIELD OF THE INVENTION

The present invention relates to a perforating wireline gun loading and, in particular, a bay in which and a method for which the explosives for perforating guns can be handled and loaded while mitigating the risk of damage due to accidental detonation.

BACKGROUND

Explosives are used widely throughout the world for a variety of applications including oilfield and mining. One application of explosives used commonly in the oil industry is the use of perforating guns, which are also termed wireline guns. The perforating guns are tubular assemblies that contain a series of explosive shaped charges. When detonated the shaped charges create a molten high-pressure jet that creates a perforation into the hydrocarbon bearing formation. The hydrocarbons can then flow into the wellbore for production of the well.

These perforating guns are commonly loaded (with shaped explosive charges) in shops or specially designated areas for safety concerns. These requirements are set by the government agencies in charge of explosive regulation. These requirements include the use of explosive magazines for storage of explosive charges and detonators and the use of shock absorbing mats in the loading areas. Security is often an issue since these areas are often open to the remainder of the shop. However, it is desirable that the areas be secured to ensure only trained personnel have access to explosives.

However, recently, it has become apparent that present loading facilities sometimes do not adequately address the risk of injury to personnel and equipment should an accidental detonation occur. In particular, the shrapnel generated by an accidental detonation perforating gun detonation can pass into adjacent open or separated work areas injuring personnel who are not at all involved in the handling of explosives or in the industry of perforating guns in general. To mitigate this risk, it has been proposed that any bay for handling perforating gun explosives be isolated to provide, what is termed a "safe quantity distance" between the loading bay and adjacent unrelated shops and people. For perforating gun-sized explosive handling, of for example, less than 20 kg explosives, the safe quantity distance can be for example 270 m. As will be appreciated, this has complicated perforating gun loading operations as it is often very difficult to provide safe quantity distance about the entire bay.

Another problem that must be addressed is relating to storage of the explosives. Explosives must be maintained in secured storage areas when not being handled to prevent access by unauthorized personnel. This often requires that the explosive be transported into and out of magazines on a regular basis, which increases the chances of accidents.

A perforating gun loading bay is required for mitigating the risks of gun explosives handling.

SUMMARY OF THE INVENTION

This patent describes a perforating gun loading bay and method for mitigating some of the risks in the loading and handling of the explosive charges used in perforating guns. The bay provides a blast-shielding or containing area for the loading of a perforating gun including blast resistant walls, roof and floor, which are selected to minimize the risk to personnel and equipment located nearby should an explosion occur. The blast resistant walls, roof and floor are designed to minimize the trajectory of explosive debris that may result from an explosive detonation while maintaining all government requirements for the loading of explosives. It is to be understood that by reference to the blast resistance of the walls, roof and floor, it is intended that they may be damaged in a blast, but they are selected to generally prevent passage therepast of the blast debris which will result from explosion of the amount of explosives, such as, for example, 20 kg or less, intended to be handled therein.

In one embodiment, the bay includes an insert-type arrangement to provide a perforating gun loading area selected to minimize the trajectory of explosive debris therefrom in at least two horizontal directions (about 90°), upwardly and downwardly and can be mounted on skids for ease of transport and positioning. In many embodiments, the insert-type arrangement is formed to minimize the trajectory of explosive debris in at least three horizontal directions (about 180°). The insert-type arrangement can be used in various ways, but, for example, can be fit into an existing shop to provide blast protection without needing to relocate the shop. As will be appreciated, since the insert-type arrangement may not minimize trajectory in all directions about the loading area, some safe quantity distance spacing may still be required about the loading area.

In another embodiment, the bay can be formed as a contained structure, such as a room or a shed, providing for perforating gun loading, explosives handling and possibly also a magazine functionality for explosives storage.

Thus, in accordance with one aspect of the invention, there is provided a perforating gun loading bay including a floor, a roof and walls, the floor, roof and walls each including a steel material layer and being selected to be blast resistant to minimize the trajectory therepast of explosive debris generated from detonation of explosives handled in a perforating gun loading operation.

The bay can include a skid for supporting the floor and walls and to facilitate transport, positioning and repositioning. The skid can be formed in any way to facilitate transport and positioning of the bay. Alternately or in addition, the bay can be formed and transportable in sections, which are connected together, as by welding, bolting, etc. on site.

In one embodiment, the bay includes a perforating gun loading area on the floor. The perforating gun loading area can be a selected spot on the floor on which it is intended that a bench or other work surface be removeably installed. Alternately, in another embodiment, the perforating gun loading area includes a bench or other work surface installed therein. Other means can be provided to ease operations within the area, such as a shock absorbing floor covering, a hoist, connections for work equipment, climate control, etc.

In one embodiment, the walls are selected to minimize trajectory from within the bay or preferably within the loading area in at least two horizontal directions, for example, which is a horizontal plane spanning at least about 90° from a point within the bay. In another embodiment, the walls are selected to minimize trajectory from within the bay or loading area in at least three horizontal directions, for example, which is a horizontal plane spanning at least about 180° from a point within the bay.

The walls can be formed to provide shock absorption, as by lining them with shock absorbing materials and/or forming them with an interior void, which can be fillable with shock absorbing materials, between the steel material layer and a second layer. Shock absorbing materials can include, for example, sand, rocks, cement, polymerics, wood, fiberglass, etc.

In one embodiment, the bay is formed to provide for minimizing the trajectory of debris, but includes a vent for release of energy generated by an explosion. Such a vent can include, for example, a floor blow-out panel, a wall vent or a roof vent. Where the floor includes a blow-out panel, the floor is formed to support a selected load but includes a panel that breaks away in the event that a load, such as an explosive blast, greater than the selected load is applied to the panel. The blow-out panel can be for example, a panel connected to the floor by shearable connections. In one embodiment, for example, the blow-out panel is defined by a plurality of slots through the floor, the slots acting to weaken the connection between the floor and the blow out panel such that it shears away by application of sufficient force thereto.

Any wall or roof vent should be selected to permit passage of explosion energy therethough preferably without itself generating shrapnel debris. In particular, although the vent can include a covering, the covering is selected to be openable without complete removal from the wall or roof on which it is mounted. One vent for positioning on a roof or wall includes an opening through the roof and a cover over the opening to prevent direct access into the opening by items falling by gravity toward the vent. In one embodiment, the cover is spaced from the opening to provide space for release of explosion gases therebetween. In another embodiment, the cover, when in a position covering the opening, is fixedly connected at a first point and releasably connected at a second point to the roof, the wall or the opening such that the cover can be released from the second point by application of pressure there against to retract it from the covering position, but yet remaining attached at the first point. The cover can be fixedly connected as by use of hinges, welds, fasteners, etc.

The bay should be sized to accommodate a perforating gun explosives housing tube therein.

In one embodiment, the perforating gun loading bay will form a room including walls about the perimeter thereof to minimize trajectory of debris therefrom about substantially 360° in a horizontal plane. In such an embodiment, the bay includes a doorway through at least one wall to provide for ingress/egress of personnel to the bay. In one embodiment, the doorway includes a first impact resistant lockable door and a second door inwardly or outwardly therefrom. The first door can be a vault-style door and the second door can include a quick-opening mechanism. A perforating gun loading bay with an impact resistant, lockable door, can be used for perforating gun loading and also for the purpose of secure storage of explosives, thereby acting as an explosives magazine. To further enhance security provided by the bay, the second door can be selected to remain closed while the vault-style door remains open and be lockable against entry into the bay.

Where the perforating gun loading bay is formed as a room, it can include a roof to, as noted above, minimize trajectory of debris upwardly. It is useful that the roof be formed as a weak point in the bay such that, in the event of an explosion requiring an escape of energy, the roof will be opened to direct the energy and debris primarily upwardly rather than outwardly through the walls.

Where the bay is formed to be useful as a magazine, the walls can be formed to prevent the passage therethrough of projectiles, such as bullets, which may cause an explosion, should they contact the explosives contained therein.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE INVENTION

Figure 1:
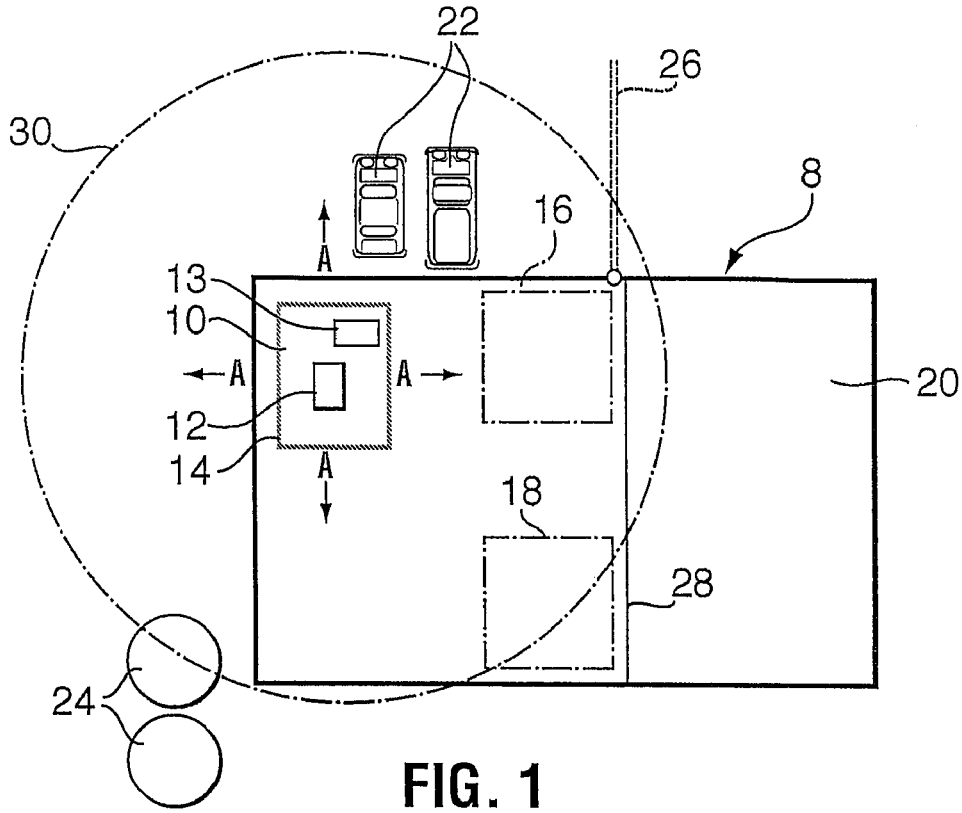
FIG. 1 PRIOR ART
FIG. 1 is a schematic layout view of a prior art-perforating gun loading shop.

FIG. 1 shows a schematic layout of a typical prior art-perforating gun loading shop 8 including a loading area 10 including a bench 12 on which the gun is loaded and a magazine 13 in which the explosives for the gun are stored. The loading area, as is common practice, is identified in the shop by a red line 14 which indicates a risk area into which entry is permitted only by authorized personnel. Generally, the area will contain less than 20 kg of explosives including those in the magazine and in guns. Some safety measures may be followed within the loading area such as the use of shock absorbing mats, etc.

According to prior art practice an unloaded wireline gun or several guns are brought into loading area 10 within red line 14 and set, for example, on the bench. The gun is then loaded by: disassembling the gun, removing explosives from magazine 13, installing the explosives in the gun and reassembling the gun. The most dangerous steps in this process are during carriage of the explosives from the magazine to the gun, during installation to the gun and during reassembly of the gun.

Often in and around the shop, there are personnel working in other areas 16, 18 and in offices 20, equipment, such as vehicles 22, liquid and gas fuel tanks 24, gas lines 26 (for example extending underground), stored chemicals and radioactive sources. These people and equipment are often separated from the loading area 10 only by the red line or by thin interior walls 28 or exterior walls and are within a damage zone, indicated at 30, should an accidental detonation occur. In particular, should a detonation occur, schrapnel would be trajected in all directions, arrows A, about, for example, 360° within zone 30. This may cause injury or death to personnel in areas 16, 18 and in offices 20, damage to equipment and secondary dangers such as explosions of stored fuel or release of harmful chemicals. Damage may also be caused to under ground structures such as gas lines 26.

In view of the foregoing, it has been considered to require significant safe quantity distance about gun loading shops, which may require many shops to be relocated at significant cost. However, it is often necessary, even where the shop itself is located, that unrelated personnel, such as office staff, or other trades people, remain in close proximity to the loading area and therefore in danger should an accidental blast occur.

Figure 2:
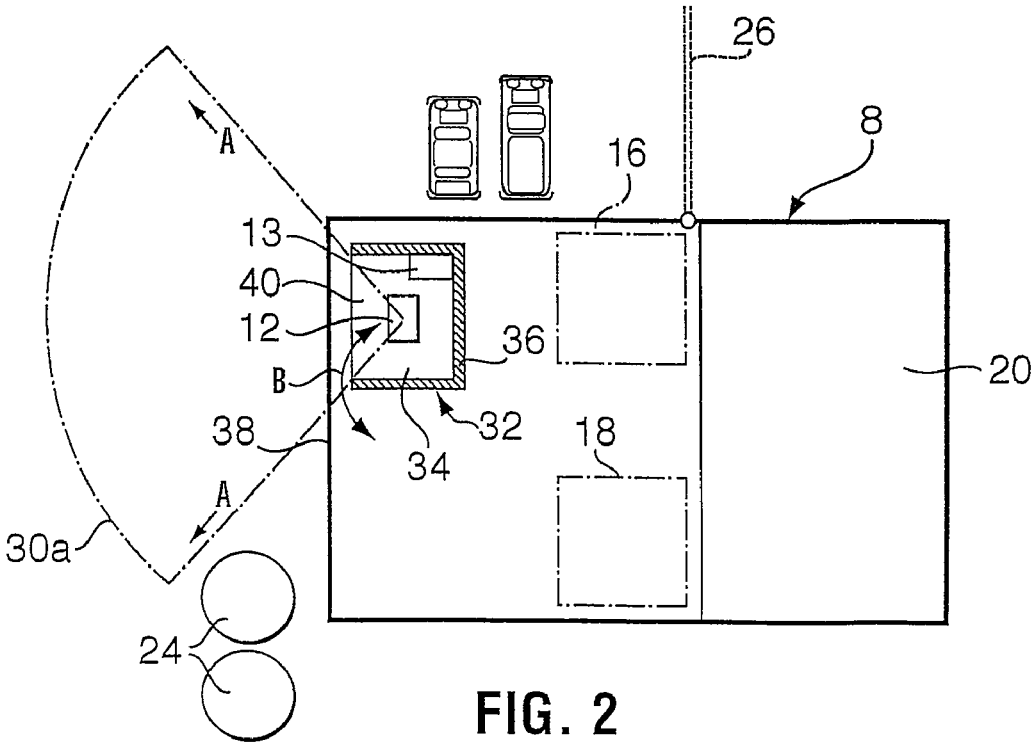
FIG. 2 is a schematic layout view of the perforating gun loading shop of FIG. 1 converted by installation of a perforating gun loading bay of the present invention.

Referring to FIG. 2, there is shown a shop 8 including a wireline gun-loading bay 32 according to the present invention. Bay 32 accommodates a bench 12 and magazine 13 and provides a loading area for loading explosives into perforating guns. Bay 32 includes a floor 34, walls 36 and a roof (which is not shown in the Figure to facilitate illustration) each formed to be blast resistant to minimize the trajectory therepast of explosive debris generated from detonation of explosives handled in a perforating gun loading operation.

The bay is of a size and type that can be inserted into an existing area of a shop. The bay can be built on site or transported in whole or in parts and brought into the shop, for example, through shop doors 38.

The bay includes an open side 40 through which ingress and egress can be made to the loading area, shown for example at arrow B. The bay can be positioned within the shop such that walls 36 shield areas 16,18, 20 from the loading area and open side 40 is directed toward a substantially clear area, for example, free of regular work areas 16,18, 20, fuel storage tanks 24, etc. In addition, floor 34 resists damage to the floor of the shop and underground structures. As such, since explosion debris substantially cannot pass through floor 34 and walls 36, bay 32 acts to reduce the trajectory, arrows A, of debris from an explosion so that zone of damage 30*a* generated during an explosion in the loading area is less than 180° in a horizontal plane outwardly from the loading area. It is noted that the actual zone 30*a* in the illustrated embodiment, extends out in a horizontal plane closer to 90° since the bench 12 and magazine 13, where the explosion is most likely to occur, is spaced back from open side 40.

Bay 32 can, therefore, be used in an existing perforating gun loading shop to limit damage due to an accidental explosion. In particular, open side 40, through which debris will be released during an explosion, can be aimed toward an area of reduced risk, such as an open yard or a shop wall, while areas containing personnel and valuable or sensitive equipment can be shielded behind walls 36. This may be useful to avoid the need for shop relocation or loading area isolation.

Figure 3:
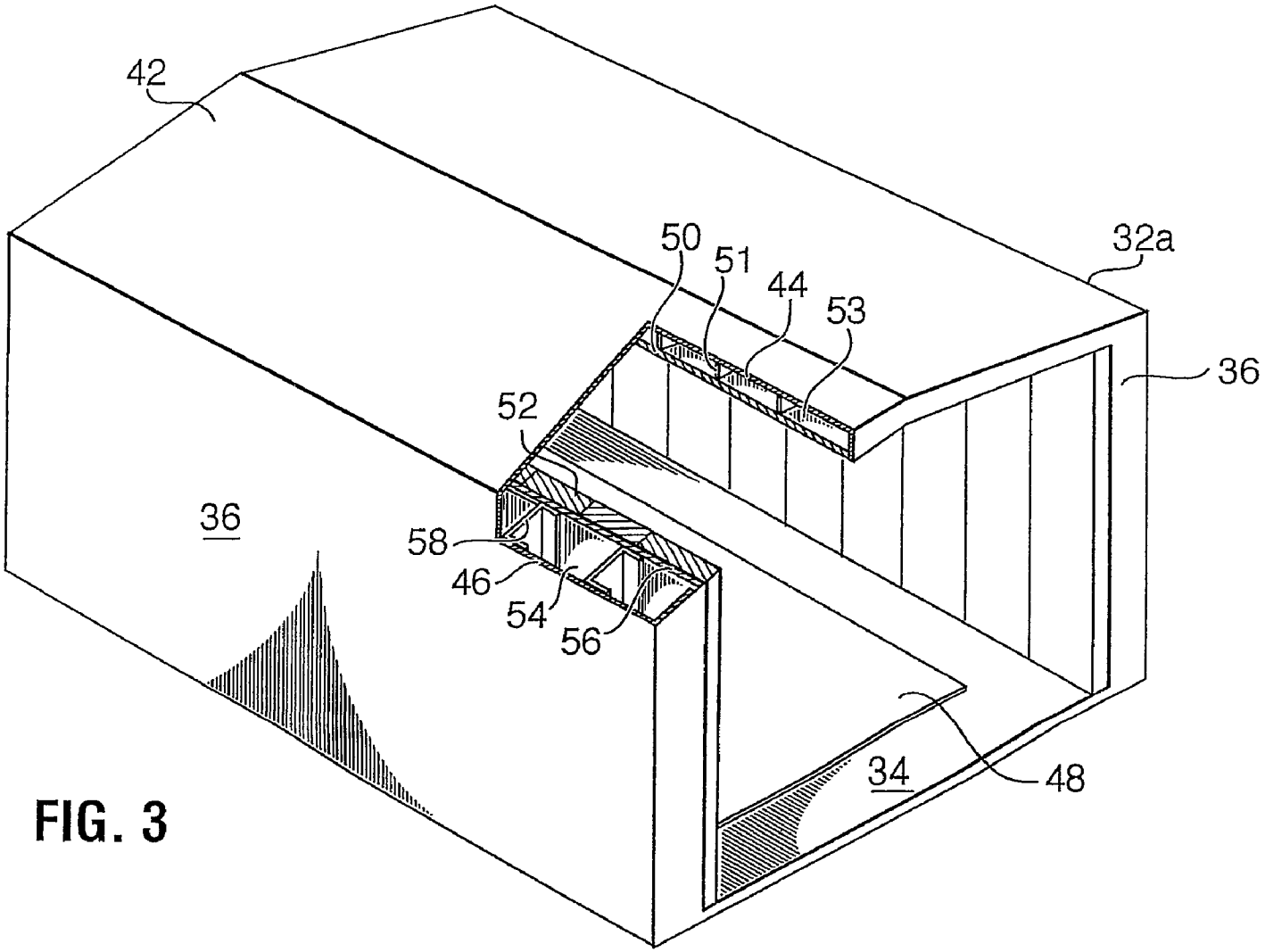
FIG. 3 is a perspective view of a perforating gun loading bay useful in a shop, such as that of FIG. 2.

Referring to FIG. 3, an insert-type perforating gun loading bay 32*a* is shown which is useful in a shop, such as that of FIG. 2. The bay 32*a* includes a floor 34 with walls 36 about three sides and an open side. Each of the floor and walls 36 is selected to be blast resistant. The bay further includes a roof 42 spanning the walls. The roof is formed to be blast resistant to minimize the trajectory of debris upwardly. Since the bay is to be used indoors, in a shop, the roof need not be formed with consideration as to weather. Therefore, it need not be peaked, although it is shown as such.

A portion of the roof and one wall is cut away to show a construction arrangement useful in the present invention. The roof is formed of an exterior steel plate 44, the walls each include exterior steel plates 46 and floor 34 is formed of a steel plate. The roof, wall and floor steel plates are each selected to create resistance to debris, resulting from the explosion of a loaded perforating gun or the explosives to be used in the gun, passing therethrough and preferably are selected to prevent passage therethrough of the debris. Suitable steel plate is for example about ¼" thick prime grade mild steel.

Floor can include thereover a shock resistant material 48 such as wood or fibreglass panels or mats of resilient material, such as rubber.

Interior to plate 44, the roof includes a shock absorbing lining 50, for example of wood, fibreglass or polymeric materials. Lining 50 is spaced from plate by brackets 51 to form therebetween a void 53 filled with air.

Walls 36 also include a shock absorbing inner lining material 52, for example of wood, fibreglass or polymerics. Since it is generally of greatest importance to limit lateral distribution of explosion energy and debris, walls 36 further include a void 54 formed between lining material 52 and plate 46. Void 54 is filled with energy absorbing/penetration limiting material, such as cement, sand, gravel or polymerics. To stabilize void 54 for supporting the filling materials, an inner liner 56 of metal, such as steel or wood panels, is supported in spaced relation from plate 46 by braces 58.

The walls, roof and floor and their individual parts can be held together in various ways, as by welding, bolting or other fasteners. For ease of assembly, steel parts can be connected by use of welding, while liners 50, 52 are attached to the steel frame by fasteners such as bolts, rivets, channels or hooks.

The area between floor 34, walls 36 and roof 42 is sufficient to provide space for perforating gun loading. However, the bay should be sized with consideration as to transportability.

Should an explosion occur in the loading area within the bay, the debris will be stopped against passage through walls 36 but will be free to pass out through the open end. Thus, in use, the bay should be positioned accordingly to minimize damage to sensitive areas.

Figure 4A:
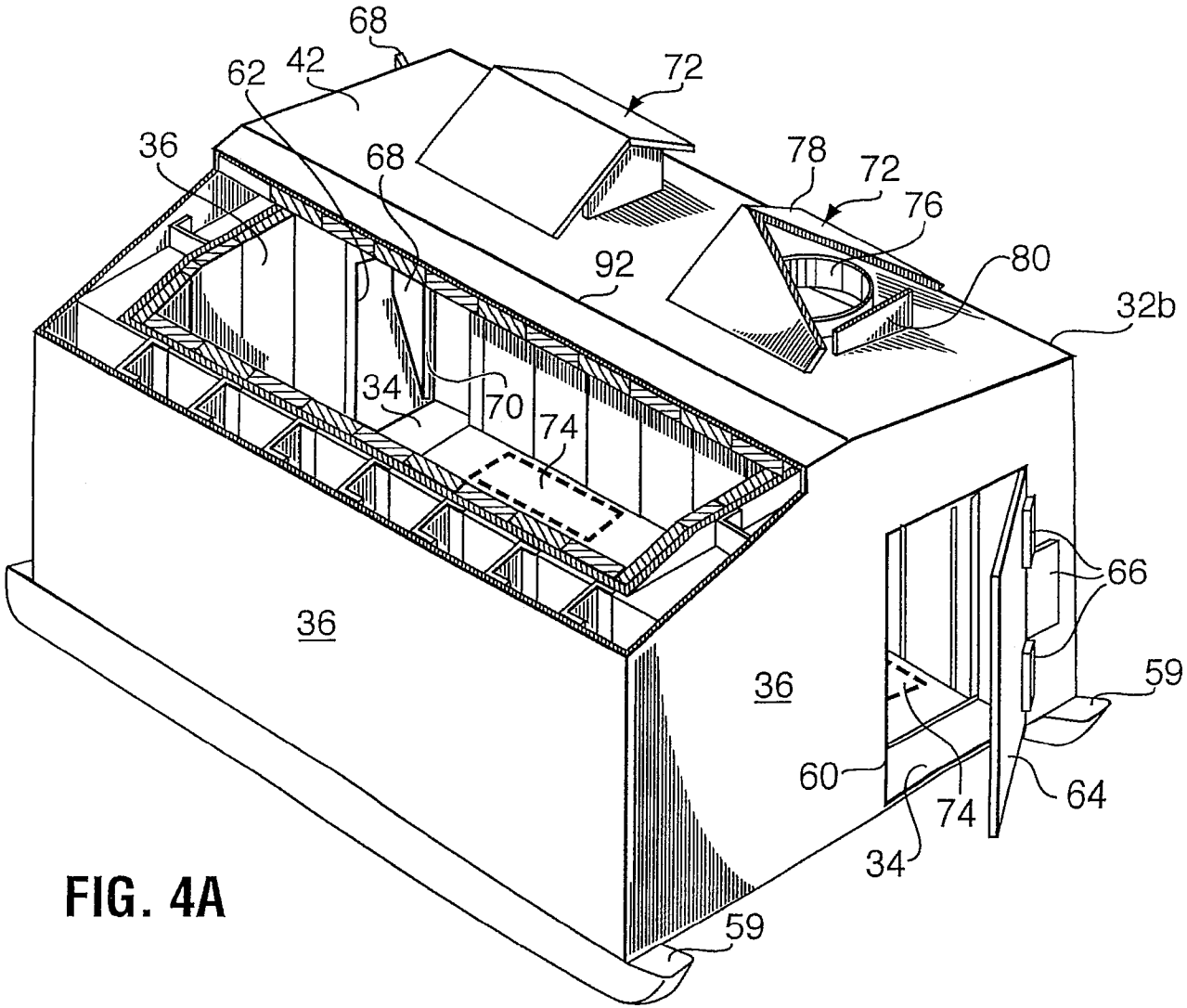
FIG. 4A is a perspective view, partially cut away, of a perforating gun loading bay according to one aspect of the present invention.
Figure 4B:
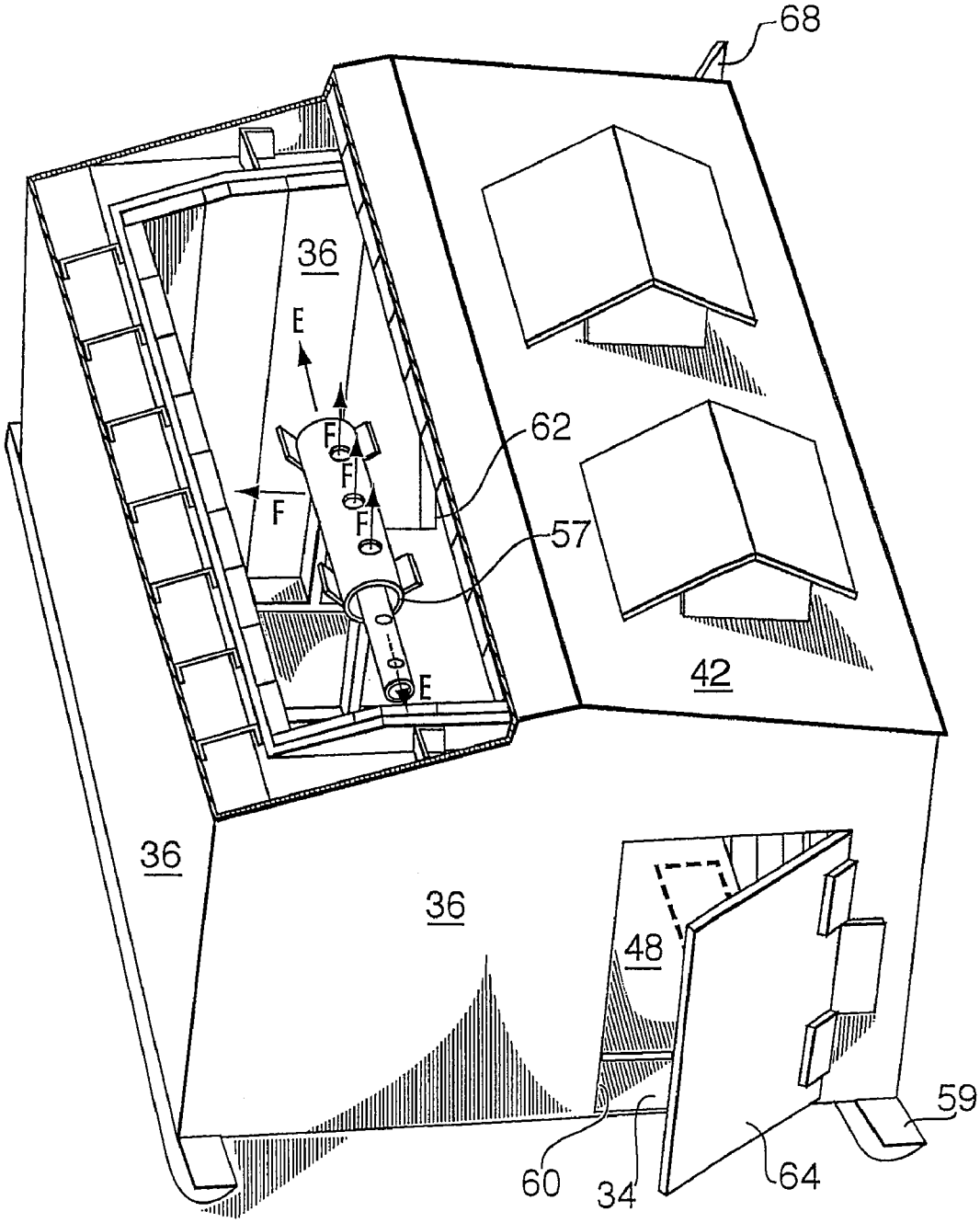
FIG. 4B is a perspective view, partially cut away, of the bay of FIG. 4A with a perforating gun housing disposed therein.

Referring to FIG. 4, another perforating gun loading bay 32*b* is shown. Bay 32*b* includes floor 34, walls 36 and roof 42. Walls 36 extend about the perimeter of the floor so that the bay forms an enclosed room wherein perforating guns, such as gun 57, can be loaded.

Bay 32*b* can be used as an insert to a shop or can be used as a stand alone structure, for example, for use on site at a petroleum well, where the loaded perforating guns will be used. Preferably, bay 32*b* is formed for portability, having a size to permit transport and including skids 59 to facilitate loading and unloading for transport.

Since the bay is enclosed by walls 36, it is necessary to provide doorways for access inside. In the illustrated embodiment, two doorways, a main doorway 60 and a secondary doorway 62, are provided. The main doorway provides the primary access to the bay and is wider to facilitate passage therethrough of equipment. The secondary doorway is provided for emergency exit. While doorways 60, 62 can remain open, in most stand alone embodiments it is desirable to provide lockable closures, such that the bay can also act as a magazine for storage therein of the explosives, even when it is unoccupied. Thus, main doorway 60 includes a lockable, impact resistant door 64 attached thereon by hinges 66 and secondary doorway includes a lockable, impact resistant door 68 mounted by hinges 70. These doors are considered vault-style doors. For emergency purposes, the doors are selected to open outwardly.

Figure 5:
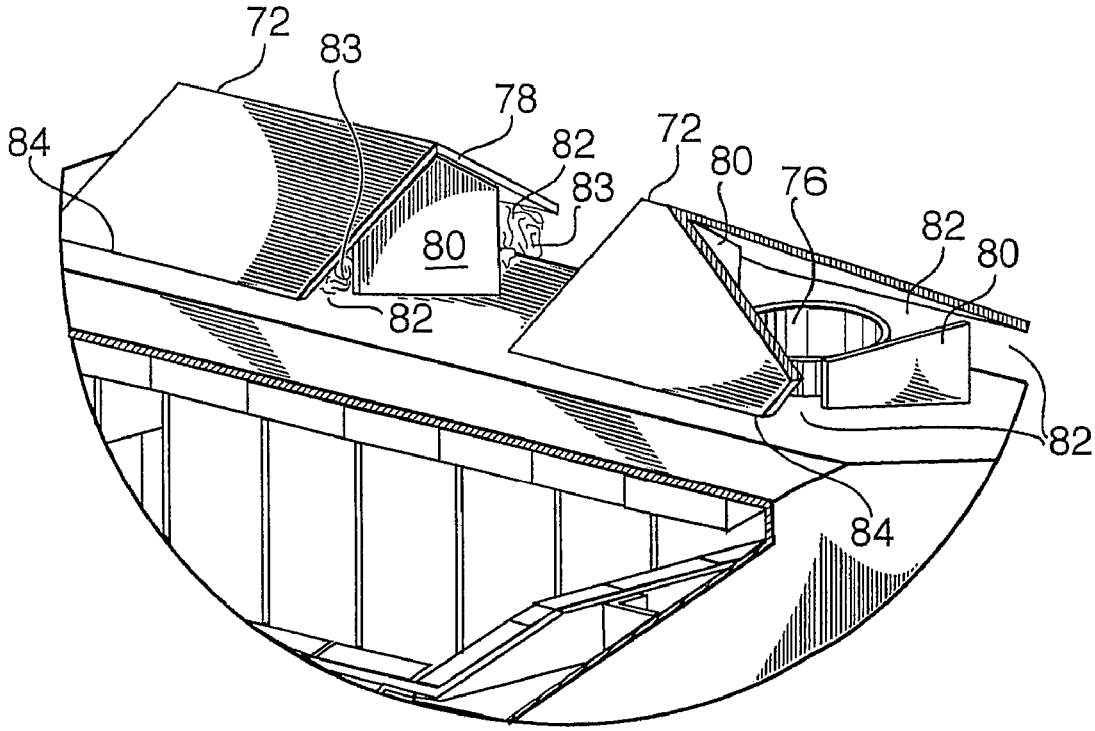
FIG. 5 is an enlarged perspective view of a portion of the roof of the bay of FIG. 4A with a roof vent partially cut away to facilitate illustration of the parts thereof.

Should an explosion occur within the bay, it is desirable that the energy be released in a controlled way, such as through roof vents 72 and floor vents 74. Referring also to FIG. 5, each roof vent 72 includes an opening 76 through the roof and a cover 78 thereover, but spaced from the opening. Cover 78 is positioned to prevent passage through opening and into the bay of precipitation and other materials falling by gravity. Members 80 are positioned beneath cover 78 to support it, but do not completely block the space between the roof and the cover, such that openings, generally indicated at 82, remain. Filtering material 83, such as fibrous insulation batting, can be stuffed beneath cover 78 to block against entry of birds, etc., but to permit passage of gas therethrough. Vents 72 therefore, permit relatively free passage therethough of pressure, but limits passage of debris because of the circuitous route out first through opening 76 and then changing direction to pass through openings 82. The vent is formed itself not to produce shrapnel.

In one embodiment, the cover is securely connected along its upper edge 84 to the roof, but less securely connected to members 80. In particular, the upper edge is connected by secure welds, while the connections to members 80 is by releasable welds, selected to shear when a significant force is applied against the cover, as by significant pressure escaping from within the bay. As such, the cover can be released to retract from its covering position over opening when it is necessary to do so for release of internal pressure. However, the edge 84 connection maintains the secure attachment of the cover so that it does not become a projectile.

Figure 6A:
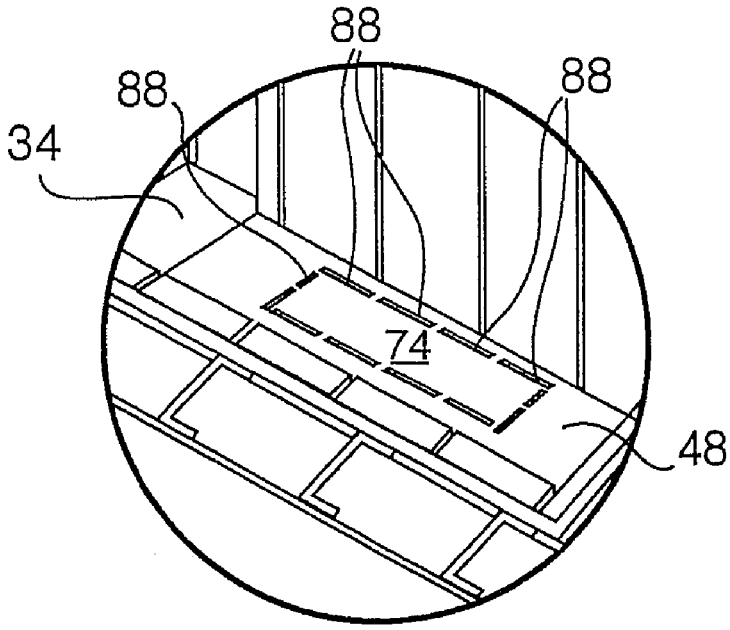
FIG. 6A is an enlarged perspective view of a portion of the floor of the bay of FIG. 4A including a blowout panel useful in the present invention.
Figure 6B:
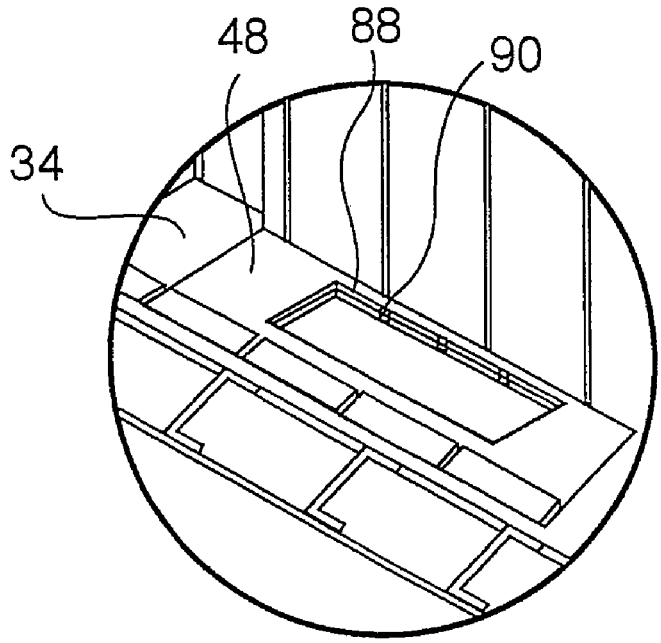
FIG. 6B corresponds to FIG. 6A, but shows the floor area after the blowout panel has been sheared away.

With reference to FIG. 6, a detailed view is shown of floor 34 configuration useful in the present invention including a shock absorbing liner 48 and floor vent 74. The floor vent acts as a blowout panel which is secured to support the weight of the passage thereover of equipment and personnel, however, is designed to blow outward and release pressure due to an explosive detonation, when significant pressure is applied thereto. These vents are formed by cutting several long slots 88 through the floor about an area to be blown out. Where the floor includes a liner 48, similarly positioned slots can also be cut therethrough. When an explosive detonation occurs, the area between the slots is sheared away, at interfaces 90, from the remainder of the floor to release pressure as shown in FIG. 6B.

The walls, floor and roof each include steel plate material. These plates can be welded together to form the individual walls, roof sections, etc. and then welded together at the interface between each wall and the roof, etc. To facilitate release of extreme pressures from explosion, in the safest way possible, the roof seams can be selected to fail first, as by using a weaker weld along the roof ridge seam 92. For example, seams between adjacent plates or at the interfaces of walls and roof can be overlapped and then welded for extra strength, with the roof is an abutting-type weld.

During an explosion, a loaded gun will explode generally in a known way. In particular, most debris during an explosion will be directed out through the ends along arrows E and radially outwardly from the sides, arrows F. Note also that vault style doors will generally be left open when personnel are working inside the bay. Thus, preferably the bay is configured such that a loading area is provided which is out of direct alignment with doorways 60, 62. This will be further illustrated in FIG. 7.

Figure 7:
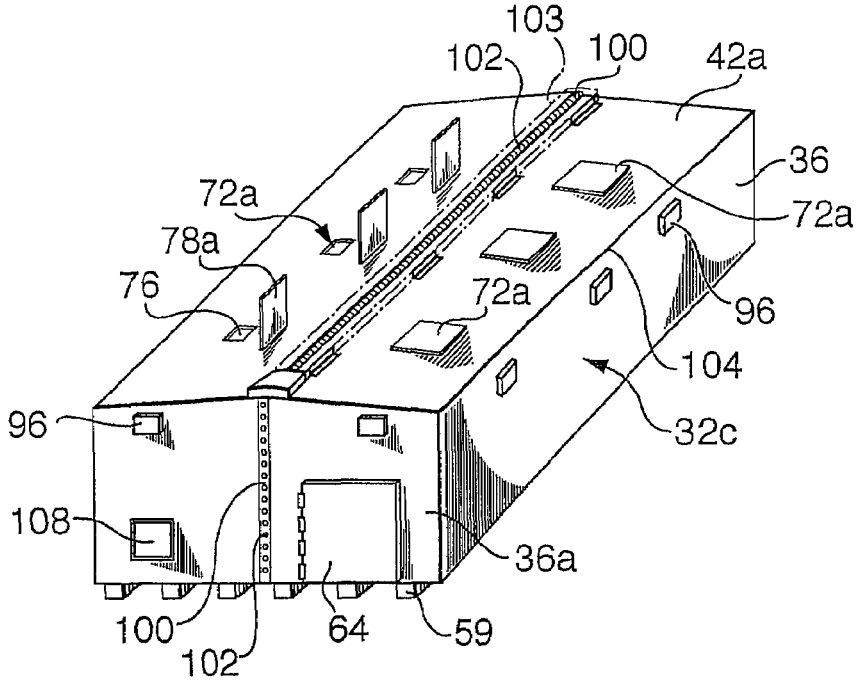
FIG. 7 is a perspective view of another perforating gun loading bay according to the present invention.

Referring to FIG. 7, there is shown another bay 32*c* according to the present invention. The bay includes a floor 34, walls 36, 36*a* and a roof 42*a*. Roof vents 72*a* are positioned on the roof and each include an opening 76 covered by a retractable cover 78*a*. Side vents 96 are also provided which include small holes (cannot be seen) in the wall and a cover which opens downwardly. These vents are generally stuffed with filtering material such as insulation batting.

The bay is of a size that permits a plurality of personnel to work therein to load perforating guns. For example, the illustrated bay is about 24' wide, 50' long and 14' high. It will be appreciated that other bay dimensions are possible. To facilitate transfer thereof, skids 59 are provided on the bay. It is useful that the bay be transportable, as it may advantageous to use the bay at one site and then transport it to another site for continued use, thereby avoiding the cost of building a bay at each site where perforating guns are to be loaded.

To further facilitate transport for a wider bay, the bay is formed in two halves separated at overlap 100. Each half of the bay is then only 12' wide and can be transported to the site of interest and the half can be connected together at that site. Connection is permitted by overlapping flanges on each half through which bolts 102 or other fasteners can be inserted. A shroud 103, shown in phantom, can be provided over the bolted flanges to deflect precipitation from leaking through this interface. It will appreciated that a narrower bay can be made in one piece without requiring bolting or assembly.

The bay is formed with an exterior metal paneling 46. To strengthen the structure, the wall panels and the adjoining roof panels are formed as one with a bend 104 at the interface. Thus, failure at the interface between walls and roof can be substantially eliminated. Interior walls, floors and ceiling are finished with plywood 52*a* with a fire retardant finish. The walls are selected to be resistant to the passage therethrough of bullets, to be impact resistant and to absorb shock, limiting passage therethrough of explosive debris.

The illustrated bay 32*c* is further equipped worker comfort and safety. In particular, the bay includes an insulation and heating/cooling units, lighting, lighting alert and protection systems and a fire suppression system. All of these systems are selected to meet the requirements for use in a handling facility for industrial explosives.

Bay 32*c* is useful as a magazine including vault-style doors 64, 68. Behind the vault-style doors, standard doors 106 (i.e. exterior entry doors or interior doors) are provided for use when personnel are working within the bay. In particular, doors 106 open outwardly and include panic bars for ease of escape. In addition, to permit added security against entry of unauthorized personnel, the doors are lockable against entry into the bay, but are openable by a key, pass code, pass card, etc.

Another door 108 is provided which opens adjacent a gun storage rack through which guns can be loaded or unloaded from the bay. Door 108 is preferably a vault-style door.

Figure 8:
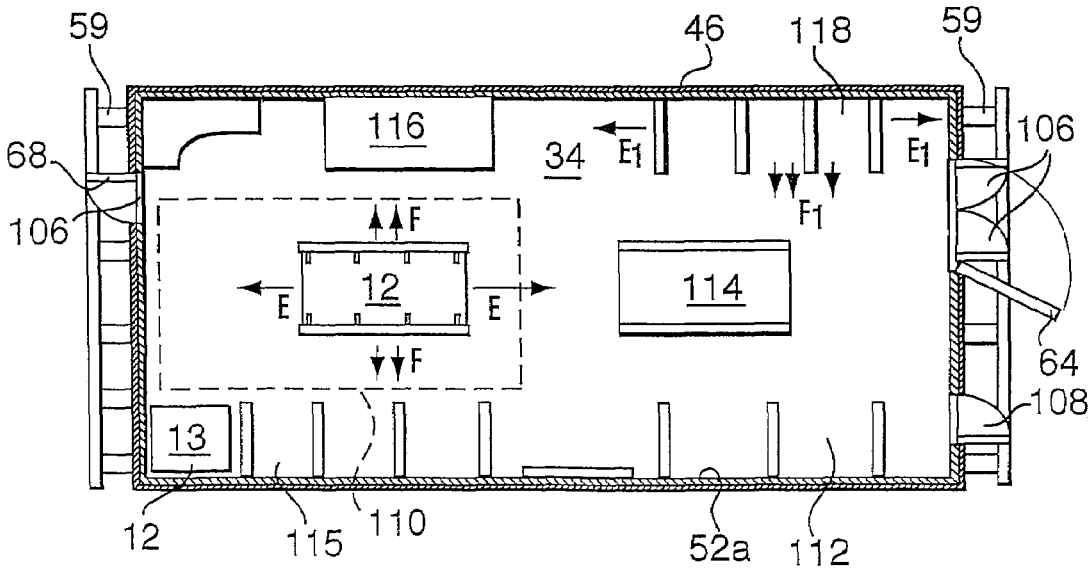
FIG. 8 is a layout view of the bay of FIG. 7.
Figure 9:
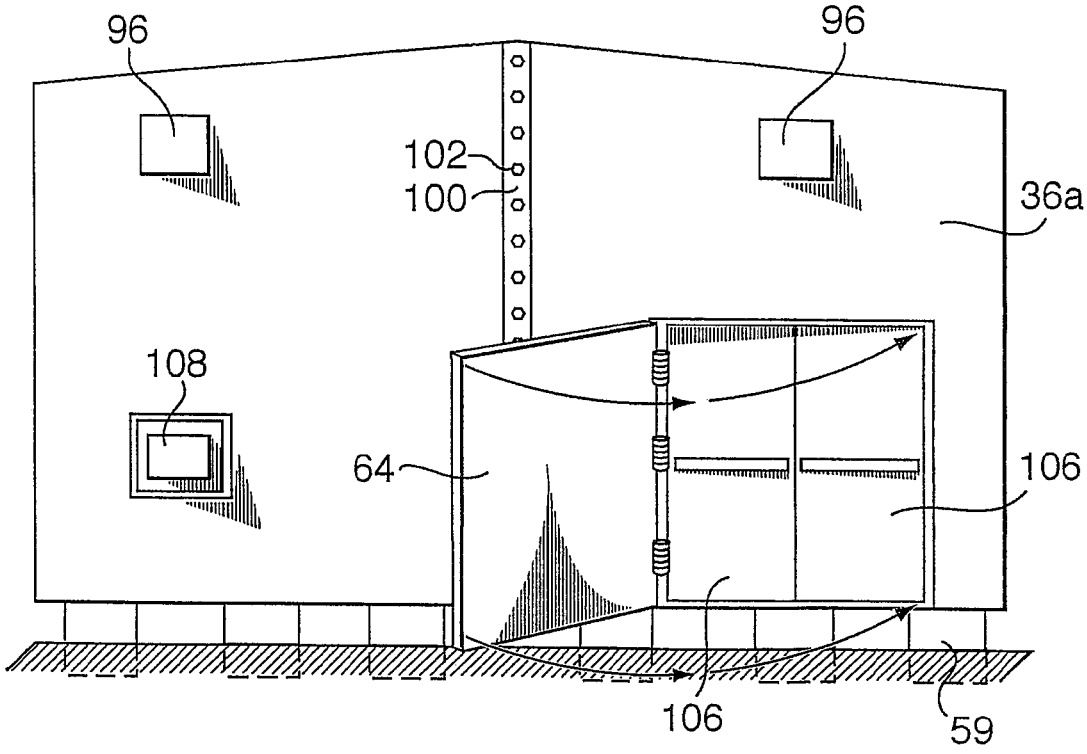
FIG. 9 is front elevation view of the bay of FIG. 7.

While other interior layouts are within the present invention, a particularly useful interior layout is shown in FIG. 8. Within the illustrated bay, there is a gun loading area, indicated generally at 110, at the center thereof including a loading bench 12, which is moveable but which can be permanently installed. A secondary magazine 13 provides extra security and protection for stored explosives. Adjacent the loading area, there is a holding area for empty gun housings 112 adjacent door 108, a gun table 114, a strip holding area 115, a work table 116 and a holding area for loaded guns 118. A hoist can be provided to facilitate gun handling between the areas.

In loading a gun, the gun housing can be inserted through door 108 onto holding area 112. When ready for loading, a gun housing is taken from the gun housing holding area and moved to gun table 114, where it is dismantled to removed the strip (the housing within the gun in which the explosives are loaded), the strip is then moved to strip holding area 115 or strips can be held there when they are provided separately from the housing. Then the strips are taken to loading table 12 where the explosives are loaded therein and the primer cord, for detonation, is installed and cut. The loaded strip is then passed back to the gun table, where it is installed in the gun housing and then the loaded gun is passed to loaded gun holding area 118, wherein they are stored until they are moved out.

The explosives are handled mainly within area 110 at the loading bench 12. However, another area of danger is loaded gun holding area 118. With consideration that loaded guns will generally create debris along arrows E and radially outwardly in the plane shown by arrows F, it is noted that magazine 13, and loaded gun holding rack 118 are out of line with the path of debris that would be created from an explosion on bench 12. In addition bench 12 is positionable such that arrows E, F, representing the paths of debris are out of line with doors 64, 68 and 108. In addition, since explosions may occur at holding area 118, this area is also situated out of line with door 64, as shown by arrows E1 and F1. This arrangement segregates the loading table area and positions it out of direct explosive path of doorways and other danger (explosive containing) areas within the bay to reduce the chance of secondary (sympathetic) explosions and minimizes the explosive debris that may exit the bay during an explosive detonation.

It will be apparent that these and many other changes may be made to the illustrative embodiments, while falling within the scope of the invention, and it is intended that all such changes be covered by the claims appended hereto.

The invention claimed is:

1. A method for loading a perforating gun comprising: providing a perforating gun loading bay including a floor, walls and a roof spanning the walls, the floor, the roof and the walls enclosing an interior work space and each being selected to be blast resistant to minimize the trajectory therepast of explosive debris generated from detonation of explosives handled in a perforating gun loading operation; moving explosives and a perforating gun housing into the perforating gun loading bay; installing explosives into the perforating gun housing while the perforating gun housing is positioned in the loading bay to obtain a loaded perforating gun; and exiting the perforating gun loading bay through a door that opens outwardly from the interior work space including operating a panic bar to open the door.

2. The method of claim 1 wherein moving explosives and a perforating gun housing into the perforating gun loading bay includes unlocking and opening a vault style door and opening the door outwardly away from the interior work space.

3. The method of claim 1 wherein after exiting, the method further comprises: locking the door.

4. A method for loading a perforating gun comprising: providing a perforating gun loading bay including a floor, walls and a roof spanning the walls, the floor, the roof and the walls enclosing an interior work space and each being selected to be blast resistant to minimize the trajectory therepast of explosive debris generated from detonation of explosives handled in a perforating gun loading operation; moving explosives and a perforating gun housing into the perforating gun loading bay; installing explosives into the perforating gun housing while the perforating gun housing is positioned in the loading bay to obtain a loaded perforating gun; and storing the loaded perforating gun in the perforating gun loading bay for later use by placing the loaded perforating gun on a storage rack.

5. The method of claim 4 wherein storing further includes locking the perforating gun loading bay against entry.

6. The method of claim 4 wherein after storing, the method further comprises passing the loaded perforating gun through a doorway adjacent a man door to remove the loaded perforating gun from the perforating gun loading bay.

7. A method for loading a perforating gun comprising: providing a perforating gun loading bay including a floor, walls and a roof spanning the walls, the floor, the roof and the walls enclosing an interior work space and each being selected to be blast resistant to minimize the trajectory therepast of explosive debris generated from detonation of explosives handled in a perforating gun loading operation; moving explosives and a perforating gun housing into the perforating gun loading bay; installing explosives into the perforating gun housing while the perforating gun housing is positioned in the loading bay to obtain a loaded perforating gun; storing the loaded perforating gun in the perforating gun loading bay for later use; and passing the loaded perforating gun through a doorway adjacent a man door to remove the loaded perforating gun from the perforating gun loading bay.

8. The method of claim 7 wherein storing includes locking the perforating gun loading bay against entry.

9. The method of claim 7 wherein storing including placing the loaded perforating gun on a storage rack.

* * * * *